US010344976B2

(12) United States Patent
Bolger

(10) Patent No.: US 10,344,976 B2
(45) Date of Patent: Jul. 9, 2019

(54) MULTIPURPOSE SOLAR LIGHTER

(71) Applicant: Joseph P. Bolger, Santa Barbara, CA (US)

(72) Inventor: Joseph P. Bolger, Santa Barbara, CA (US)

( * ) Notice: Subject to any disclaimer, the term of this patent is extended or adjusted under 35 U.S.C. 154(b) by 74 days.

(21) Appl. No.: 15/680,694

(22) Filed: Aug. 18, 2017

(65) Prior Publication Data

US 2017/0343214 A1 Nov. 30, 2017

Related U.S. Application Data

(63) Continuation-in-part of application No. 14/520,253, filed on Oct. 21, 2014, now abandoned.

(51) Int. Cl.
*F23Q 1/06* (2006.01)
*F23Q 13/00* (2006.01)
*F23Q 3/01* (2006.01)

(52) U.S. Cl.
CPC ..... *F23Q 13/005* (2013.01); *F23Q 1/06* (2013.01); *F23Q 3/01* (2013.01)

(58) Field of Classification Search
CPC ..... F23Q 13/005; F23Q 1/06
USPC ..... 126/681, 699, 680
See application file for complete search history.

(56) References Cited

U.S. PATENT DOCUMENTS 4,076,014 A * 2/1978 Wiquel ..... F23Q 13/005 126/698
4,363,147 A * 12/1982 Deweese ..... B25F 1/00 7/158
5,927,272 A * 7/1999 Robertson ..... F23Q 13/005 126/699
2009/0214996 A1* 8/2009 Putrello ..... F23Q 1/06 431/273
2015/0026429 A1* 1/2015 Bobroff ..... G06F 12/0253 711/171

* cited by examiner

*Primary Examiner* — Avinash A Savani
*Assistant Examiner* — Aaron H Heyamoto
(74) *Attorney, Agent, or Firm* — Olav M. Underdal; IDP Patent Services

(57) ABSTRACT

A multipurpose solar lighter for conveniently lighting a cigarette, tinder, or other flammable objects, includes a hollow upper part, which further includes an upper elongated piece, a convex lens, and a stopping tab, and a window with an optical filter; and a hollow lower part; such that the upper part connects to the lower part, whereby a cigarette can be inserted into the solar lighter, until it reaches the stopping tab, and is lighted by focused solar light. The upper part can also be used separately to ignite tinder. Furthermore, the solar lighter can include a fire steel surface and a fire striker, and end mounted pivotable thumb tabs for holding the upper and lower parts, when striking the fire steel surface with the fire striker to produce sparks that can light a fire.

18 Claims, 6 Drawing Sheets

Multipurpose Solar Lighter

Multipurpose Solar Lighter

Multipurpose Solar Lighter

Multipurpose Solar Lighter with Fire Steel

MULTIPURPOSE SOLAR LIGHTER

CROSS-REFERENCE TO RELATED APPLICATIONS

This United States Non-Provisional application is a continuation-in-part of U.S. Non-Provisional application Ser. No. 14/520,253, filed Oct. 21, 2014.

FIELD OF THE INVENTION

The present invention relates generally to the field of lighter devices, and more particularly to methods and systems for using solar energy to function as a cigarette lighter, in combination with other lighting mechanisms.

BACKGROUND OF THE INVENTION

Fire-making or burning lenses, in the form of a convex lens that can concentrate solar light and thereby ignite an exposed surface, have been known since ancient times.

Similarly, fire striker devices have been used since in various forms since early times. Originally used by striking iron pyrites with flint, later devices and methods used steel with various types of hard rock.

Even in modern times there is widespread interest in the outdoor community in fire-making devices that use natural and traditional methods for lighting a fire or lighting tobacco products.

Devices exist for lighting a cigarette with focused sunlight and modern fire steel devices are also widely available. However, these devices are restricted in that they only allow one mode of usage, and one method of ignition, and therefore a hiker may be forced to carry several devices, or resort to inconvenient procedures for using one device for several purposes, some of which the device may not have been designed for.

As such, considering the foregoing, it may be appreciated that there continues to be a need for novel and improved lighter and fire-making devices and methods.

SUMMARY OF THE INVENTION

The foregoing needs are met, to a great extent, by the present invention, wherein in aspects of this invention, enhancements are provided to the existing model of solar lighters.

In an aspect, a multipurpose solar lighter for convenient lighting of a cigarette, tinder, or similar objects, can include an upper part which is hollow and has a convex lens mounted to an upper front end, and further includes a stopping tab, which is mounted so that a lower edge of the stopping tab is substantially in the focal plane of the convex lens; and a lower part, which is a hollow piece, that is open in both ends, such that the upper and lower parts can be connected, thereby forming an internal cavity In a related aspect, a cigarette can be inserted into the cavity, until the cigarette reaches the stopping tab, whereby a tip of the cigarette is positioned at the focal point of the convex lens, such that sunlight can be focused by the convex lens on the tip of the cigarette, thereby lighting the cigarette.

In a related aspect, the upper and lower parts can be screwed together.

In a related aspect, the upper part can further include one or more ventilation holes.

In a related aspect, the upper part can further include a window, such that a user can see the inside, and for example, in some related aspects, view ignition of the cigarette tip by the focused sunlight.

In a further related aspect, the window can be made of heat-resistant borosilicate glass.

In a related aspect, the upper part can be used separately to light a piece of tinder, by pointing the convex lens towards the sun and directing the other end of the upper part, to rest against the tinder.

In another aspect, the multipurpose solar lighter can further include a fire steel function, such that the multipurpose solar lighter further includes a fire striker and a ridged steel surface mounted on respectively the upper and lower parts, or alternatively on respectively the lower and upper parts. The multipurpose solar lighter can further include thumb caps, which are mounted on both the upper and lower parts to aid a user in holding the upper and lower parts when striking the ridged steel surface with the fire striker.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
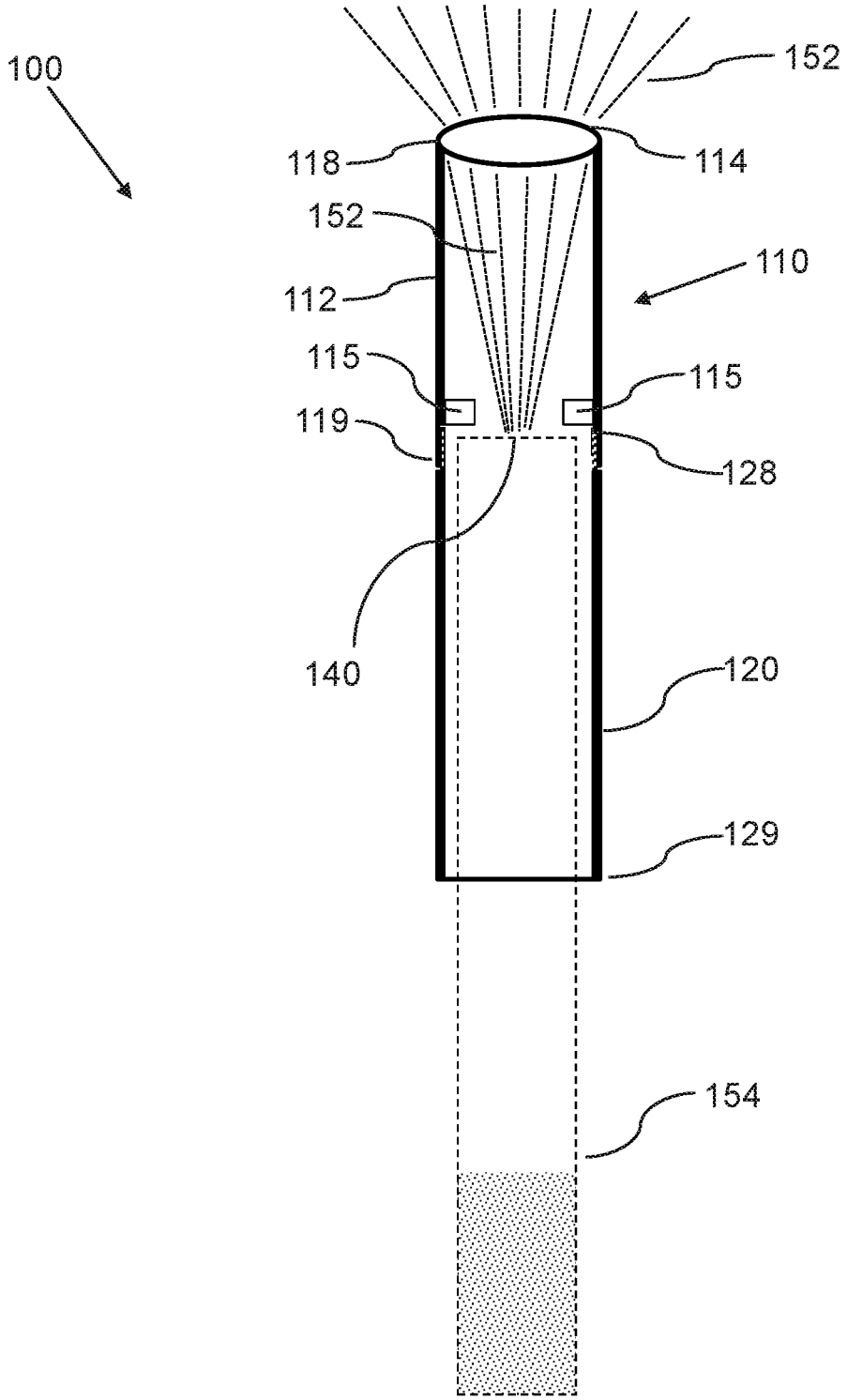
FIG. 1 is a center-cut cross-sectional side view of a multipurpose solar lighter, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a multipurpose solar lighter 100 with reference to FIG. 1, in such manner that like reference numerals refer to like components throughout; a convention that we shall employ for the remainder of this specification.

In an embodiment, a multipurpose solar lighter 100 for conveniently lighting a cigarette, tinder, or other objects, can include:

a) An upper part 110, further comprising:
   i. an upper elongated piece 112, which is hollow and open in an upper front end 118 and an upper rear end 119;
   ii. A convex lens 114, which is mounted in an opening of the upper front end 118; and
   iii. At least one stopping tab 115, which is mounted inside the upper part 110, such that a lower edge of the stopping tab 115 is substantially in the plane of the focal point 140 of the convex lens 114; and b) A lower part 120, which is an elongated hollow piece, which is open in a lower front end 128 and a lower rear end 129;

such that a front end of the lower part is detachably connected to the rear end of the upper part with a connection mechanism, such that the multipurpose solar lighter 100 is hollow from below the convex lens 114 in the upper front end 118 to the lower rear end 129, forming a cavity with an opening in the lower rear end 129;

whereby a cigarette 154 can be inserted into the cavity, such that it reaches and is stopped by the stopping tab 115, whereby a tip of the cigarette is positioned at the focal point 140 of the convex lens 114, whereby a strong external light source 152, such as sunlight 152, can be focused by the convex lens 114 on the tip of the cigarette, thereby lighting the cigarette. Lighting the cigarette in most cases takes about 3 seconds from full insertion.

The various embodiments of the multipurpose solar lighter 100 thereby provide a natural ignition aided by the sun, avoiding any butane inhalation In a related embodiment, such as shown in FIG. 1, the connection mechanism can be comprised of an inner threading on an inside of the upper rear end 119 of the upper part 110, and an outer threading on an outside of the lower upper end of the lower part 120, such that the lower part 120 screws into the upper part 110.

In alternative related embodiments, the connection mechanism can be a snap-connector with a ball release, or similar well known detachable connection mechanisms.

In a related embodiment, the stopping tab 115 can instead be mounted in the lower part 120.

Figure 2:
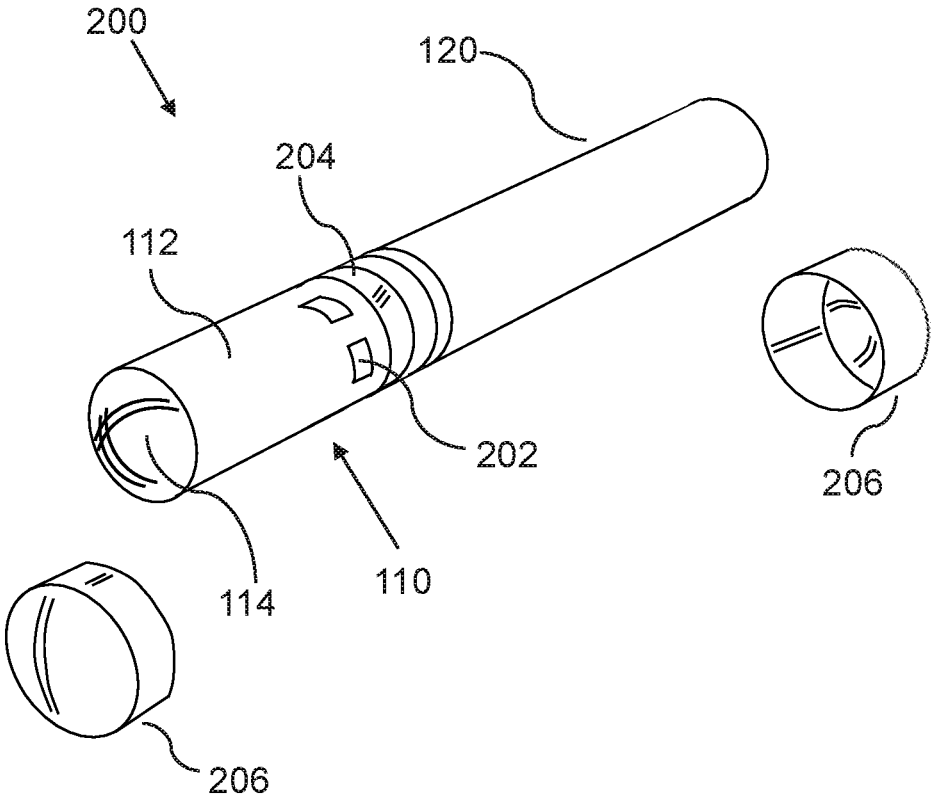
FIG. 2 is a perspective view of a multipurpose solar lighter, according to an embodiment of the invention.

In a related embodiment, FIG. 2 shows a front perspective view of a multipurpose solar lighter 100 in an assembled state.

In a related embodiment, shown in FIG. 2, the upper elongated piece 112 can further include at least one ventilation hole 202. The ventilation holes 202 can for example be positioned 0.5 inches above the upper rear end of the upper part 110.

In a related embodiment, shown in FIG. 2, the upper elongated piece 112, or alternatively the lower elongated piece 120 or both upper and lower parts/elongated pieces 112 120, can further include at least one window 204, which is a transparent piece made of a heat-resistant material, such that the window 204 allows visibility to the cavity inside the multi-purpose solar lighter 100. The window 204 can for example be configured as one band of heat-resistant glass, such that the upper elongated piece 112, includes an upper cylinder, the band of heat resistant glass, and a lower cylinder. In this example, the band of heat-resistant glass can for example be glued with heat-resistant adhesive or screwed together with the upper and lower cylinders.

In a further related embodiment, the heat-resistant material can for example be borosilicate glass.

In a further related embodiment, the window 204 can be tinted, whereby the window tinting prevents any eye damage from visibility to focused light 152 and ignited material inside the multi-purpose solar lighter 100. In related embodiments, the window tinting can be similar to optical filters used in welding helmets and goggles.

In other further related embodiments, the window 204 can be configured as an optical filter, for example designed to transmit at least 50%, 60%, 70%, 80%, 90%, 60-90%, or 10-90% of light in the visible spectrum of 390 to 700 nm, such that:

a) The window 204 can be configured as an ultraviolet cut-off filter, such that the window 204 is configured to cut-off electromagnetic radiation below a predetermined ultraviolet wavelength threshold, such as for example according to the L-37 or L-39, standards; for example, such that transmission percentage, which can also be referred to as fractional transmittance, is below 50% for wavelengths below 390 nm and below 5% for wavelengths below 360 mm; or such that transmission percentage is below 50% for wavelengths below 400 nm, and below 5% for wavelengths below 350 nm; or such that transmission percentage is below 50% for wavelengths below 370 nm, and below 5% for wavelengths below 330 nm;

b) The window 204 can be configured as an infrared cut-off filter, such that the window 204 is configured to cut-off electromagnetic radiation above a predetermined infrared wavelength threshold, for example such that transmission percentage is below 50% for wavelengths above 700 nm and below 5% for wavelengths above 800 mm; or such that transmission percentage is below 50% for wavelengths above 720 nm, and below 10% for wavelengths above 800 nm. The infrared cut-off filter can be absorptive or reflective, and manufactured according to well-known methods. A window 204 configured as a reflective infrared cut-off filter can aid in ignition due to additional heat retention at the point of ignition 140, i.e. at the focal point 140 of the convex lens 114, inside the multipurpose solar lighter 100;

c) The window 204 can be configured as a neutral-density filter, such that the window 204 is configured to reduce electromagnetic radiation across all wavelengths; for example, such that transmission percentage is 50%, 25%, 12.5%, 6.25%, 3.125%, 1.563%, 1%, etc.; or reduced with a predetermined transmission percentage in a range of for example 75%-0.01% or 50%-1%; or d) a combination of these configurations.

In yet a further related embodiment, the multipurpose solar lighter 200 can further comprise one or two caps 206 for placing on an end of the multipurpose solar lighter 200. A cap 206 can be placed on the upper front end of the upper elongated piece 112, to protect the convex lens 114, and prevent light entering the convex lens 114, as a safety measure to prevent accidental damage from focused light. In addition, a cap 206 can be placed on a lower rear end of the lower part 120. The cap 206 can for example be made of a plastic or rubber material, and can for example be designed to fit snuggly on the end or be screwed on.

Figure 3:
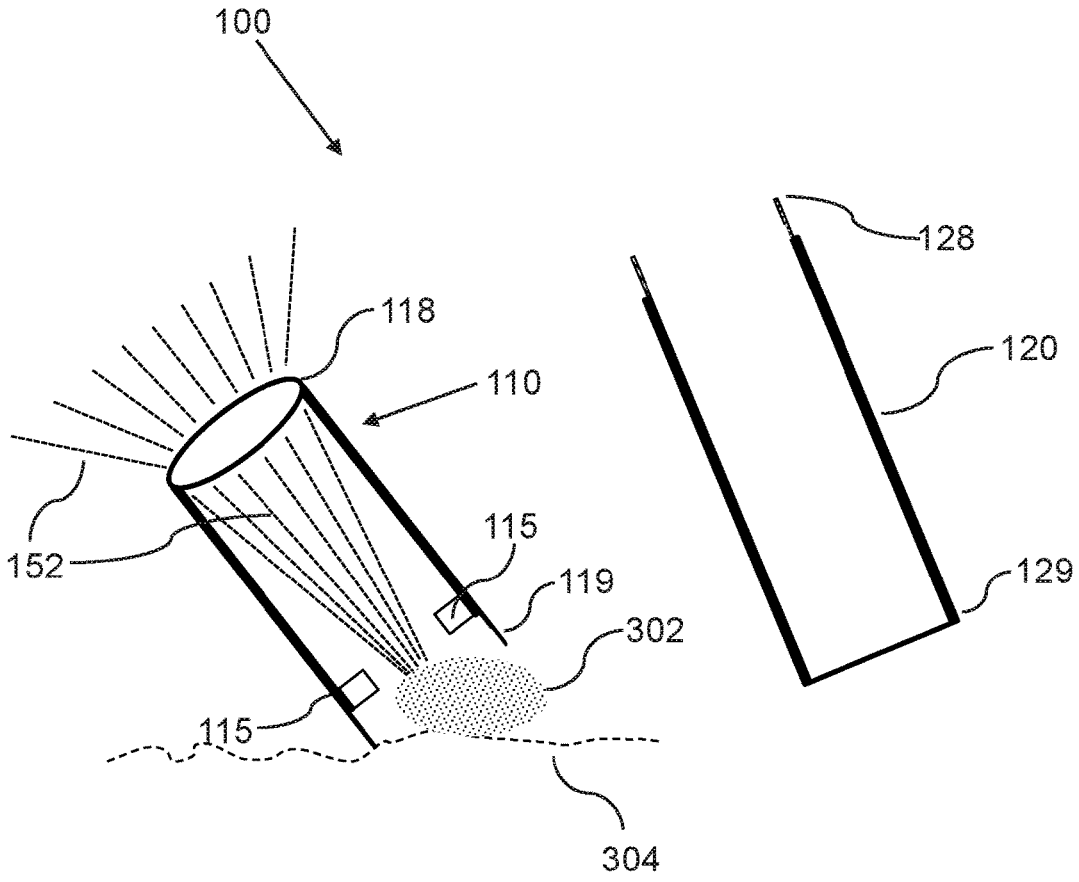
FIG. 3 is a center-cut cross-sectional side view of a disassembled multipurpose solar lighter, according to an embodiment of the invention.

In a related embodiment, FIG. 3 shows a center-cut side view of a multipurpose solar lighter 100 in a dissembled state, such that the upper part 110 has been separated from the lower part 120. Here, it is shown how the upper part 110 can be used to light a piece of tinder 302, or other ignitable object, for example positioned on a surface 304, by pointing the convex lens 114 towards the sun or another light source and directing the upper rear end 119 of the upper part 110, to rest against the tinder 302 such that a surface of the tinder 302 is stopped substantially at the location of the stopping tab 115, whereby the tinder 302 surface can be ignited in the focal point 140 of the convex lens 114.

Figure 4:
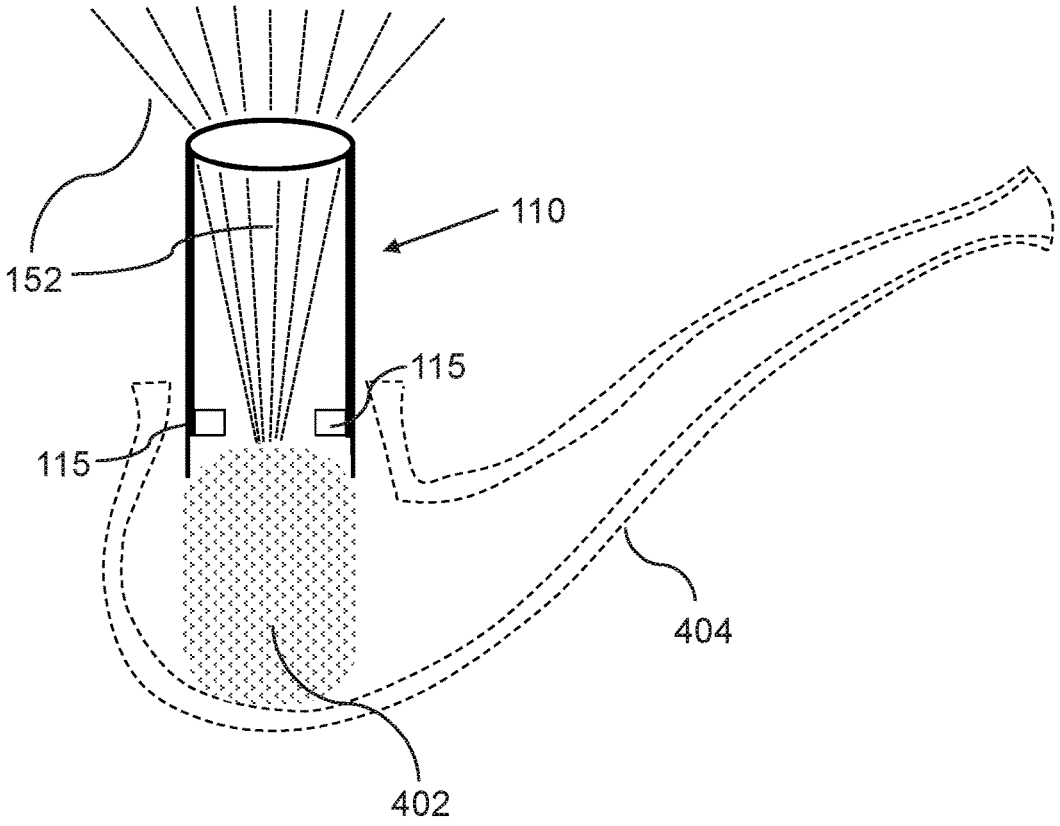
FIG. 4 is a center-cut cross-sectional side view of use of an upper part of a multipurpose solar device, according to an embodiment of the invention.

In a related embodiment, FIG. 4 shows a related use, wherein the upper part 110 can be used to light tobacco 402 in a pipe 404, by pointing the convex lens 114 towards the sun or another light source and directing the upper rear end of the upper part 110, to rest against the tobacco 402 such that a surface of the tobacco 402 is stopped substantially at the location of the stopping tab 115, whereby the tobacco 402 surface can be ignited in the focal point 140 of the convex lens 114.

In a related embodiment, the upper part 110 can be used to ignite gas emitting from a gas burner, such as used for camping, by pointing the convex lens 114 toward the sun or another light source and directing the upper rear end of the upper part 110, into the gas, whereby the gas can be ignited in the focal point 140 of the convex lens 114.

In an embodiment, the length of the multipurpose solar lighter 100 can be 3 inches long, with a width of ⅜ inches.

In related embodiments, the upper elongated part and the lower part can be made from a plastic material, including ABS; or a metal or metal alloy, such as aluminum or an aluminum alloy, steel, including stainless steel; and other suitable materials.

Figure 5A:
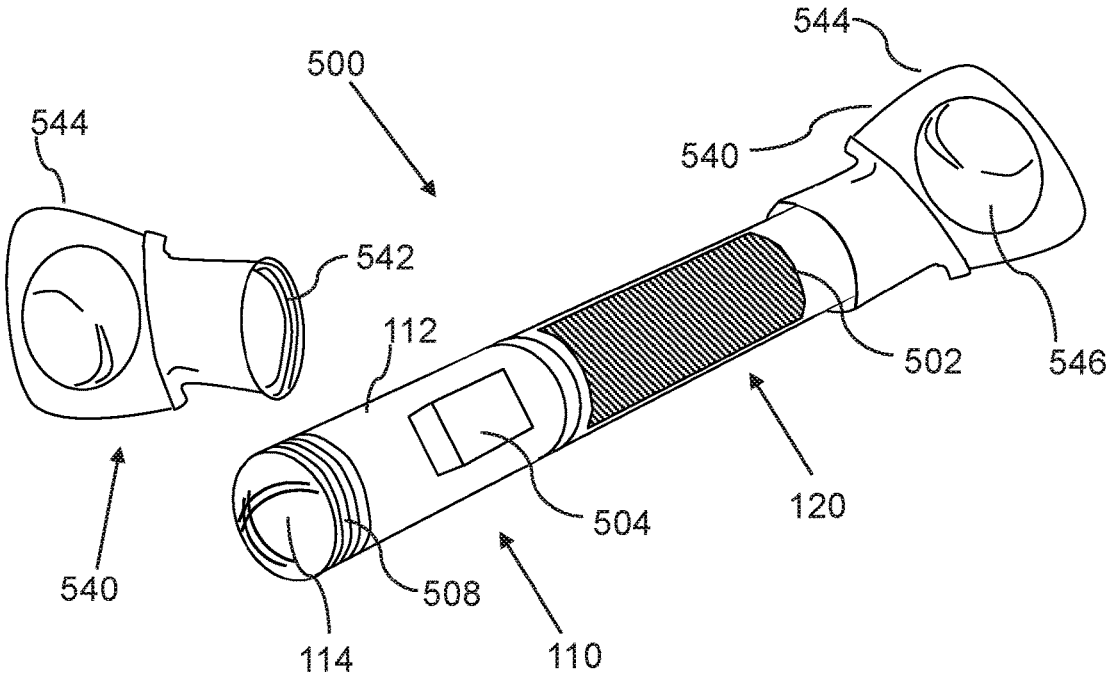
FIG. 5A is a perspective view of a multipurpose solar device, according to an embodiment of the invention.

In an embodiment, as illustrated in FIG. 5A, a multipurpose solar lighter 500 can further be configured with a fire steel function, such that the multipurpose solar lighter 500 further includes:

a) A protruding fire striker 504, which is mounted to the upper elongated piece 112 which can be made of flint, chert, a ferrocerium material, or another suitable striker material known in the art of fire steel and fire strikers;

b) A ridged steel surface 502, which can be a steel cylinder with outer ridges placed around the lower part 120 or can be an integral part of a lower part made fully or partially of steel, wherein part of the surface of the lower part 120 is a steel surface with ridges.

In a related embodiment, the ferrocerium material can include a composition in percentages by weight of:

a) 19% iron;
b) 47% cerium;
c) 22% lanthanum;
d) 4% neodymium;
e) 4% praseodymium;
f) 4% magnesium.

In a related embodiment, as shown in FIG. 5A, the multipurpose solar lighter 500, can further include two thumb caps 540 with an inner threaded aperture 542 that screws onto respectively the front upper end, which further includes an outer threading 508, and the rear lower end, which further includes an outer threading (not visible in FIG. 5). Thereby a user can attach the thumb caps 540 to respectively the upper and lower parts 110 120, separate the upper and lower parts 110 120, and produce sparks by striking the ridged steel surface 502 with the protruding fire striker 504, whereby the sparks can ignite an object, such as tinder or a gas flowing from a gas burner.

Figure 5B:
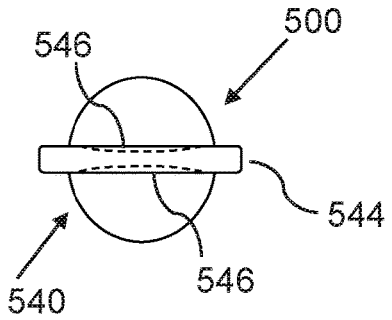
FIG. 5B is a rear view of a multipurpose solar device, according to an embodiment of the invention.

In a related embodiment, as shown in FIGS. 5A and 5B, the thumb caps 540 can be configured as tabs 544 on outer ends of the thumb caps 540, such that the tabs 544 can be substantially flat, and such that the tabs can further comprise thumb indentations 546.

Thus, in a related embodiment, the multipurpose solar lighter 500, can further include:

a) a first thumb cap 540, further configured with a first inner threaded aperture 542; and b) a second thumb cap 540, further configured with a second inner threaded aperture 542;

such that the first thumb cap 540 screws onto a front of the upper part 110, wherein the front of the upper part 110 further comprises a first outer threading 508; and such that the second thumb cap 540 screws onto a rear of the lower part 120, wherein the rear of the lower part 120 further comprises a second outer threading;

wherein the first and second thumb caps 540 are configured as tabs;

whereby the first and second thumb caps 540 are configured to aid a user in holding the upper and lower parts 110 120 when striking the ridged steel surface 502 with the protruding fire striker 504;

whereby a user attaches the first and second thumb caps 540 to respectively the upper and lower parts 110 120, which are separated, and produce sparks by striking the ridged steel surface 502 with the protruding fire striker 504, thereby producing sparks, which ignite an object.

Figure 6A:
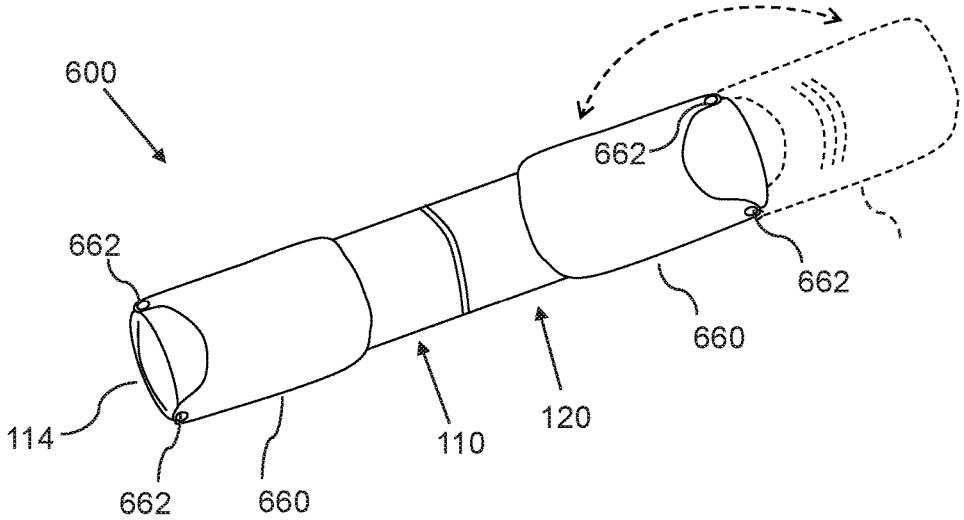
FIG. 6A is a perspective view of a multipurpose solar device with pivotable thumb tabs folded in, according to an embodiment of the invention.
Figure 6B:
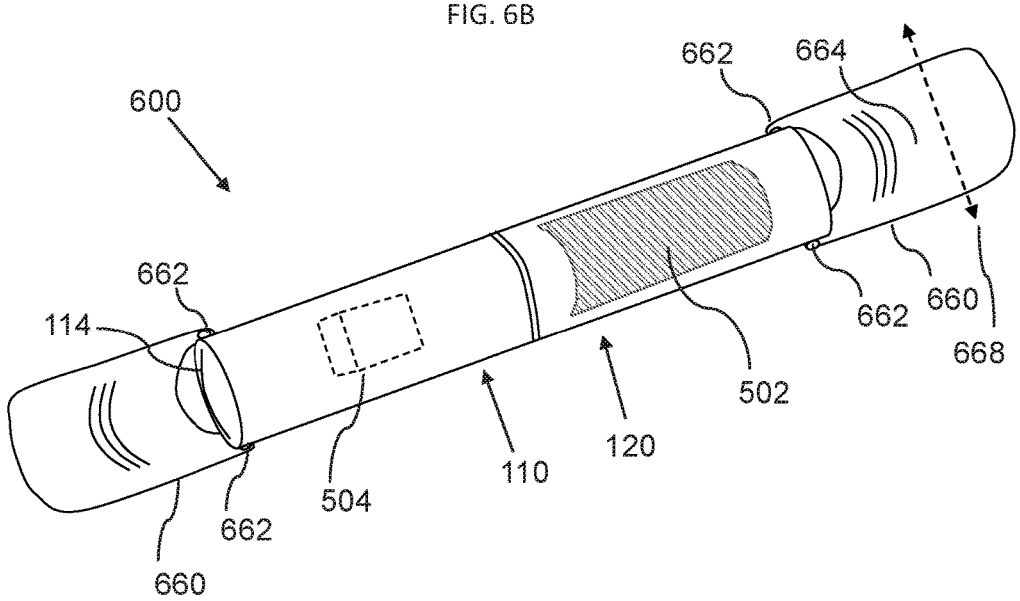
FIG. 6B is a perspective view of a multipurpose solar device with pivotable thumb tabs folded out, according to an embodiment of the invention.
Figure 6C:
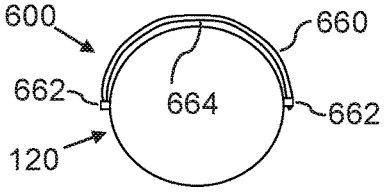
FIG. 6C is a rear view of a multipurpose solar device with pivotable thumb tabs folded in, according to an embodiment of the invention.
Figure 6D:
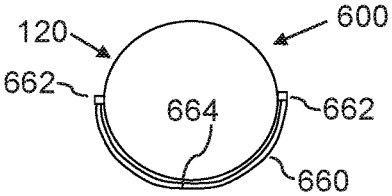
FIG. 6D is a rear view of a multipurpose solar device with pivotable thumb tabs folded out, according to an embodiment of the invention.

In a related embodiment, as shown in FIGS. 6A and 6B, the multipurpose solar lighter 600, can further include front and rear thumb tabs 660, which are pivotally mounted in pivotal points 662, which are positioned in respectively a front of the upper part 110 and a rear of the lower part 120, such that:

a) The front and rear thumb tabs 660, as shown in FIG. 6A can be folded in, such that they are aligned with, and folded along, respectively the upper and lower parts 110 120; and b) The front and rear thumb tabs 660, as shown in FIG. 6B can be folded out, such that they extend from respectively the upper and lower parts 110 120, and such that the front and rear thumb tabs 660 are substantially parallel to respectively the upper and lower parts 110 120.

In a related embodiment, FIG. 6B indicates the ridged steel surface 502 and the protruding fire striker 504 in dotted lines, to show their positioning on an opposing side of the side that the front and rear thumb tabs 660 fold onto when folded in.

In a further related embodiment, as shown in FIGS. 6A, 6B, 6C, and 6D, the front and rear thumb tabs 660 can be curved, such that the front and rear thumb tabs 660 align with curvatures of respectively the upper and lower parts 110 120, and such that left and right thumbs of a user fit snuggly in inner sides 664 of the front and rear thumb tabs 660, wherein the inner sides are concave in a lateral direction 668.

Thus, in a related embodiment, the multipurpose solar lighter 500, can further include:

a) a first/front thumb tab 660, which is pivotally connected to a front of the upper part 110; and b) a second/rear thumb tab 660, which is pivotally connected to a rear of the lower part 120;

wherein the front and rear thumb tabs 660 are configurable to be folded in, such that the front and rear thumb tabs 660 are aligned with, and folded along, respectively the upper and lower parts 110 120;

wherein the front and rear thumb tabs 660 are configurable to be folded out, such that the front and rear thumb tabs 660 extend from respectively the upper and lower parts 110 120, such that the front and rear thumb tabs 660 are substantially parallel to respectively the upper and lower parts 110 120;

whereby the front and rear thumb tabs 660, when folded out, are configured to aid a user in holding the upper and lower parts 110 120 when striking the ridged steel surface 502 with the protruding fire striker 504;

whereby a user separates the upper and lower parts 110 120 and strike the ridged steel surface 502 with the protruding fire striker 504, thereby producing sparks, which ignite an object The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A multipurpose solar lighter for conveniently lighting a cigarette, tinder, or other objects, comprising:

a) an upper part, further comprising:

an upper elongated piece, which is hollow, and open in an upper front end and open in an upper rear end;

a convex lens; which is mounted in an opening of the upper front end; and at least one stopping tab, which is mounted inside the upper part, such that a lower edge of the stopping tab is substantially in the plane of a focal point of the convex lens; and b) a lower part, which is an elongated hollow piece, which is open in a lower front end and open in a lower rear end;

such that a front end of the lower part is detachably connected to the rear end of the upper part with a connection mechanism, such that the multipurpose solar lighter is hollow from below the convex lens in the upper front end to the lower rear end, forming a cavity with an opening in the lower rear end;

such that the connection mechanism is mounted immediately below the at least one stopping tab;

wherein the upper elongated piece further comprises at least one window, which is a transparent piece made of a heat-resistant material, such that the window allows visibility to the cavity inside the multi-purpose solar lighter;

wherein the at least one window is configured as an optical filter, such that the optical filter is configured to prevent eye damage from visibility to focused light in the cavity;

wherein the at least one window is configured as a neutral-density filter, such that the at least one window is configured to reduce electromagnetic radiation across all wavelengths, such that transmission percentage is in a range of 75%-0.01%;

whereby when a cigarette is inserted into the cavity, such that it reaches and is stopped by the stopping tab, thereby a tip of the cigarette is positioned at the focal point of the convex lens, thereby a strong external light source is focused by the convex lens on the tip of the cigarette, thereby lighting the cigarette;

whereby, when the upper part is separated from the lower part, the upper part is configured to ignite an ignitable object, when the upper rear end of the upper part is directed to rest against the ignitable object such that a surface of the ignitable object is stopped substantially at a location of the stopping tab, whereby the ignitable object is ignited in the focal point of the convex lens.

2. The multipurpose solar lighter of claim 1, wherein the connection mechanism further comprises an inner threading on an inside of the upper rear end of the upper part, and an outer threading on an outside of the lower upper end of the lower part, such that the lower part screws into the upper part.

3. The multipurpose solar lighter of claim 1, wherein the upper elongated piece further comprises at least one ventilation hole.

4. The multipurpose solar lighter of claim 1, wherein the heat-resistant material is borosilicate glass.

5. The multipurpose solar lighter of claim 1, wherein the at least one window is configured as an ultraviolet cut-off filter, such that the at least one window is configured to cut-off electromagnetic radiation below a predetermined ultraviolet wavelength threshold, such that transmission percentage is below 50% for wavelengths below 400 nm, and below 5% for wavelengths below 350 nm.

6. The multipurpose solar lighter of claim 1, wherein the at least one window is configured as an infrared cut-off filter, such that the at least one window is configured to cut-off electromagnetic radiation above a predetermined infrared wavelength threshold, such that transmission percentage is below 50% for wavelengths above 720 nm, and below 10% for wavelengths above 800 nm.

7. The multipurpose solar lighter of claim 6, wherein the infrared cut-off filter is a reflective infrared cut-off filter, whereby the at least one window is configured to aid in ignition due to additional heat retention at the focal point of the convex lens.

8. The multipurpose solar lighter of claim 1, further comprising at least one cap for placing on an end of the multipurpose solar lighter.

9. The multipurpose solar lighter of claim 1, wherein the upper elongated piece is cylindrical and the lower part is cylindrical.

10. The multipurpose solar lighter of claim 1, further comprising:

a) a protruding fire striker, which is mounted to the upper elongated piece, such that the protruding fire striker is made from a fire striker material; and b) a ridged steel surface, wherein a surface of the lower part further comprises the ridged steel surface.

11. The multipurpose solar lighter of claim 10, wherein the fire striker material is a ferrocerium material.

12. The multipurpose solar lighter of claim 10, further comprising:

a) a first thumb cap, further configured with a first inner threaded aperture; and b) a second thumb cap, further configured with a second inner threaded aperture;

such that the first thumb cap is configured to screw onto a front of the upper part, wherein the front of the upper part further comprises a first outer threading; and such that the second thumb cap is configured to screw onto a rear of the lower part, wherein the rear of the lower part further comprises a second outer threading;

wherein the first and second thumb caps are configured as tabs;

whereby the first and second thumb caps are configured to aid a user in holding the upper and lower parts when striking the ridged steel surface with the fire striker;

whereby a user attaches the first and second thumb caps to respectively the upper and lower parts, which are separated, and produce sparks by striking the ridged steel surface with the protruding fire striker, thereby producing sparks, which ignite an object.

13. The multipurpose solar lighter of claim 10, further comprising:

a) a front thumb tab, which is pivotally connected to a front of the upper part; and b) a rear thumb tab, which is pivotally connected to a rear of the lower part;

wherein the front and rear thumb tabs are configurable to be folded in, such that the front and rear thumb tabs are aligned with, and folded along, respectively the upper and lower parts;

wherein the front and rear thumb tabs are configurable to be folded out, such that the front and rear thumb tabs extend from respectively the upper and lower parts, such that the front and rear thumb tabs are substantially parallel to respectively the upper and lower parts;

whereby the front and rear thumb tabs, when folded out, are configured to aid a user in holding the upper and lower parts when striking the ridged steel surface with the protruding fire striker;

whereby a user separates the upper and lower parts and strike the ridged steel surface with the protruding fire striker, thereby producing sparks, which ignite an object.

14. The multipurpose solar lighter of claim 13, wherein the front and rear thumb tabs are curved, such that the front and rear thumb tabs align with curvatures of respectively the upper and lower parts, such that inner sides of respectively the front and rear thumb tabs are concave in a lateral direction.

15. A multipurpose solar lighter for conveniently lighting a cigarette, tinder, or other objects, comprising:

a) an upper part, further comprising:

an upper elongated piece, which is hollow, and open in an upper front end and open in an upper rear end;

a convex lens; which is mounted in an opening of the upper front end; and at least one stopping tab, which is mounted inside the upper part, such that a lower edge of the stopping tab is substantially in the plane of the focal point of the convex lens; and b) a lower part, which is an elongated hollow piece, which is open in a lower front end and open in a lower rear end;

such that a front end of the lower part is detachably connected to the rear end of the upper part with a connection mechanism, such that the multipurpose solar lighter is hollow from below the convex lens in the upper front end to the lower rear end, forming a cavity with an opening in the lower rear end;

wherein the upper elongated piece further comprises at least one window, which is a transparent piece made of a heat-resistant material, such that the window allows visibility to the cavity inside the multi-purpose solar lighter;

wherein the at least one window is configured as an optical filter, such that the optical filter is configured to prevent eye damage from visibility to focused light in the cavity;

wherein the at least one window is configured as an ultraviolet cut-off filter, such that the at least one window is configured to cut-off electromagnetic radiation below a predetermined ultraviolet wavelength threshold, such that transmission percentage is below 50% for wavelengths below 400 nm, and below 5% for wavelengths below 350 nm;

whereby when the cigarette is inserted into the cavity, such that it reaches and is stopped by the stopping tab, a tip of the cigarette is positioned at the focal point of the convex lens, whereby a strong external light source is focused by the convex lens on the tip of the cigarette, thereby lighting the cigarette.

16. A multipurpose solar lighter for conveniently lighting a cigarette, tinder, or other objects, comprising:

a) an upper part, further comprising:

an upper elongated piece, which is hollow, and open in an upper front end and open in an upper rear end, wherein the upper elongated piece further comprises:

a protruding fire striker, which is mounted to the upper elongated piece, such that the protruding fire striker is made from a fire striker material;

a convex lens; which is mounted in an opening of the upper front end; and at least one stopping tab, which is mounted inside the upper part, such that a lower edge of the stopping tab is substantially in the plane of the focal point of the convex lens;

b) a lower part, which is an elongated hollow piece, which is open in a lower front end and open in a lower rear end, wherein the lower part further comprises:

a ridged steel surface, wherein a surface of the lower part further comprises the ridged steel surfaces;

c) a front thumb tab, which is pivotally connected to a front of the upper part; and d) a rear thumb tab, which is pivotally connected to a rear of the lower part;

wherein the front and rear thumb tabs are configurable to be folded in, such that the front and rear thumb tabs are aligned with, and folded along, respectively the upper and lower parts;

wherein the front and rear thumb tabs are configurable to be folded out, such that the front and rear thumb tabs extend from respectively the upper and lower parts, such that the front and rear thumb tabs are substantially parallel to respectively the upper and lower parts;

whereby the front and rear thumb tabs, when folded out, are configured to aid a user in holding the upper and lower parts when striking the ridged steel surface with the fire striker;

whereby a user separates the upper and lower parts and strike the ridged steel surface with the protruding fire striker, thereby producing sparks, which ignite an object;

such that a front end of the lower part is detachably connected to the rear end of the upper part with a connection mechanism, such that the multipurpose solar lighter is hollow from below the convex lens in the upper front end to the lower rear end, forming a cavity with an opening in the lower rear end;

whereby when a cigarette is inserted into the cavity, such that it reaches and is stopped by the stopping tab, thereby a tip of the cigarette is positioned at the focal point of the convex lens, thereby a strong external light source is focused by the convex lens on the tip of the cigarette, thereby lighting the cigarette.

17. The multipurpose solar lighter of claim 16, wherein the front and rear thumb tabs are curved, such that the front and rear thumb tabs align with curvatures of respectively the upper and lower parts, such that inner sides of respectively the front and rear thumb tabs are concave in a lateral direction.

18. A multipurpose solar lighter for conveniently lighting a cigarette, tinder, or other objects, comprising:

a) an upper part, further comprising:

an upper elongated piece, which is hollow, and open in an upper front end and open in an upper rear end;

a convex lens; which is mounted in an opening of the upper front end; and at least one stopping tab, which is mounted inside the upper part, such that a lower edge of the stopping tab is substantially in the plane of the focal point of the convex lens; and b) a lower part, which is an elongated hollow piece, which is open in a lower front end and open in a lower rear end;

such that a front end of the lower part is detachably connected to the rear end of the upper part with a connection mechanism, such that the multipurpose solar lighter is hollow from below the convex lens in the upper front end to the lower rear end, forming a cavity with an opening in the lower rear end;

wherein the upper elongated piece further comprises at least one window, which is a transparent piece made of a heat-resistant material, such that the window allows visibility to the cavity inside the multi-purpose solar lighter;

wherein the at least one window is configured as an optical filter, such that the optical filter is configured to prevent eye damage from visibility to focused light in the cavity;

wherein the at least one window is configured as an infrared cut-off filter, such that the at least one window is configured to cut-off electromagnetic radiation above a predetermined infrared wavelength threshold, such that transmission percentage is below 50% for wavelengths above 720 nm, and below 10% for wavelengths above 800 nm;

whereby when the cigarette is inserted into the cavity, such that it reaches and is stopped by the stopping tab, a tip of the cigarette is positioned at the focal point of the convex lens, whereby a strong external light source is focused by the convex lens on the tip of the cigarette, thereby lighting the cigarette.

* * * * *